United States Patent [19]

Repp et al.

[11] Patent Number: 4,962,371

[45] Date of Patent: Oct. 9, 1990

[54] CPS ALARM SYSTEM

[75] Inventors: Bradley A. Repp, Woodbridge; Albert M. Wurm, Colonial Beach; Adam J. Simonoff, Dahlgren; Spencer R. Courtney, Fredricksburg, all of Va.

[73] Assignee: The United States of America as represented by the Secretary of the Navy, Washington, D.C.

[21] Appl. No.: 270,555

[22] Filed: Nov. 14, 1988

[51] Int. Cl.[5] ..... G08B 21/00

[52] U.S. Cl. ..... 340/626; 340/691; 340/501; 340/525; 340/286.01

[58] Field of Search ..... 340/626, 691, 501, 511, 340/525, 870.09, 870.16, 870.17, 286 M, 286 R, 286, 825.25, 544, 505, 506; 73/753

[56] References Cited

U.S. PATENT DOCUMENTS

| | | | |
|---|---|---|---|
| 2,493,548 | 1/1950 | Proctor | 340/525 |
| 3,475,750 | 10/1969 | Howell | 340/870.09 |
| 3,588,868 | 6/1971 | Head | 340/286 |
| 3,599,199 | 8/1971 | Bunting | 340/286 |
| 3,797,009 | 3/1974 | Crudgington, Jr. | 340/286 |
| 3,914,755 | 10/1975 | Hook | 340/544 |
| 4,117,479 | 9/1978 | Galvin | 340/506 |
| 4,494,106 | 1/1985 | Smith | 340/870.09 |
| 4,555,694 | 11/1985 | Yauagishima | 340/286 |

*Primary Examiner*—Joseph A. Orsino
*Assistant Examiner*—Kinfe-Michael Negash
*Attorney, Agent, or Firm*—John D. Lewis; Kenneth E. Walden

[57] ABSTRACT

An improved collective protection system (CPS) alarm is generally comprised of an electronic circuit board terminal box that is readily connectable to any selected point of a ship power bus system. The system is provided with a plurality of pressure transducers that are selectively disposed in associated remote zones to be continuously monitored. A master monitoring panel is connected to the terminal box and is provided with a pressure indicating meter and a series of three red, yellow, and green lights corresponding to each remotely monitored zone. Separate slave panels allows monitoring of light status at additional locations such as a pilot house and/or a damage control station. The system is appropriately shielded to prevent EMI or RFI interference.

20 Claims, 3 Drawing Sheets

CPS ALARM SYSTEM

The invention described herein may be manufactured and used by or for the Government for governmental purposes without the payment of any royalty thereon.

BACKGROUND OF THE INVENTION

This invention relates to an electrical atmospheric pressure alarm. In particular, a collective protective system (CPS) alarm adaptable to shipboard spaces to warn personnel of unacceptably low over-pressures in interior spaces protected from chemical, biological and radiological (CBR) contamination is hereinbelow disclosed.

Naval warships and land based buildings used as combat information centers have long been pressurized to protect against airborne intrusion of chemical biological and radiological contamination. Current systems now widely used in our fleet employ a single red light and audible alarm to inform the bridge that overpressure has been lost in a protected space. The Navy standard interior communications/status monitoring (IC/SM) alarm panel now widely used throughout protected Navy ships is of this type. These systems employ a pressure transducer in a protected zone warning of pressure loss by lighting a red light and sounding a buzzer at the master panel monitoring station. However, a single red light does not provide indication of whether pressure in the protected zone is rising or falling, or whether pressure is low but not falling, etc.

The commanders need as much warning as possible, however, and a single light/alarm provides notice but not advance warning. It is imperative that battle commanders know if overpressure is falling in a protected zone in time to warn personnel to don individual respirators or other protective gear. With the single alarm system now in use, the battle commander learns of a CBR contamination only after the fact. It is imperative that advance notice be provided battle commanders if they are to take the protective measures necessary to continue fighting the ship while sustaining a CBR attack.

In addition to the battle commander, other stations on the ship need to know the status of atmospheric overpressure in CBR protected spaces. For instance, if structural damage has occurred and a protected space has lost its overpressure, a damage control or repair station needs to have this information if they are to attempt repair in a timely manner. Other areas of a warship can use this status information along with the bridge and damage control stations, such as the combat information center, the pilot house, and so forth. Because of its hostile operating environment, a CPS alarm system must not be vulnerable to Electro-Magnetic Interferrance (EMI) or other radiation. The CPS alarm system must be versatile to be adaptable to various ships large and small, as well as shore-based protected facilities. Other applications, such as space stations, have need for improved CPS alarm systems.

Therefore, one object of the present invention is to provide a continuous along display of protected zone pressure to a master panel.

Another object of this disclosure is to teach a CPS alarm system that provides lights indicating when overpressure is low as well as when it is normal or completely lost.

Still another object of the instant invention is to provide a CPS alarm system capable of monitoring one or many separate protection zones.

A further object of the present invention is to teach a shipboard CPS alarm system that can provide pressure fail information to one or more slave stations as well as the master monitoring station.

Another object of this invention is to provide a CPS alarm system which can operate reliably in a hostile EMI or Radio Frequency Interference (RFI) environment.

Still another object of this disclosure is to teach a CPS alarm system easily adaptable to a shipboard power bus.

Yet another object of the instant invention is to provide a versatile improved CPS alarm system constructed from off the shelf components available both commercially and through the military supply system.

SUMMARY OF THE INVENTION

These and other objects are obtained by a CPS alarm system comprised of a master panel, one or more slave panels, one or a plurality of zone pressure sensor boxes and interconnecting cabling. Signal transfers are made through a common terminal box and the system obtains electrical power from the shipboard power distribution bus.

Each pressure sensor box contains a differential pressure transducer and gauge. The transducer provides an output voltage proportional to zone overpressure to the master panel. The circuitry in each zone monitoring channel is modularized and plugs in and out of a motherboard for ease of maintenance. A set screw potentiometer allows a one-time adjustment to calibrate and each zone module is polarized to preclude incorrect installation.

One embodiment built and tested by the inventors comprised a master panel located in the ships Damage Control Central (DCC). The master panel contained a series of ammeters, one for each zone, and a red, yellow and green light for each zone gauge. The master panel utilized 110 V/60 Hz power and attached directly to the ship's power distribution bus in DCC. The embodiment tested monitored five CPS zones but it should be understood that any number of individual CPS zones can be monitored without departing from the invention.

In the test system, two slave panels, one in the pilot house and one in a repair station, provided a red light indication for each CPS zone. The red light corresponding to each zone was slaved to the master panel red light and illuminated whenever overpressure was lost in the corresponding zone. The slave panels are similar to the CPS alarms currently in use in that they provide only after-the-fact fail information for each protection zone. The slave panels contained no electronic circuitry and were connected to and driven by the master panel via a terminal box.

Each zone pressure sensor box contains a differential pressure transducer and gauge. The transducer provides an output voltage proportional to zone overpressure to the master panel. For shipboard use, three ranges of protection were established and color-coded on the master panel for easy visual identification. Red, 0–0.4 inches of water (gauge) indicated a casualty mode of no protection. Yellow, 0.4–1.5 inches of water (gauge) showed a deficiency of overpressure and $>1.5$ inches of water (gauge) indicated a fully protected overpressure zone. These parameters were design choice and do not limit the scope of the CPS alarm in any way.

The master panel houses the system power supply and most of the electronic circuitry. It contains a motherboard and a plurality of daughter boards depending on the number of zones being monitored. The system built to test had capabilities of monitoring 5 zones with five separate daughter boards corresponding to five meters on the master panel. Each meter had its reflection range divided by color with the color corresponding to the inches of water (gauge) detailed above. Each of the five meters had 3 associated color-coded lights to provide immediate reference of zone pressure status. The master panel is powered by 110 V/60 Hz and develops a 12 VDC signal which is sent from the master panel to each pressure sensor box to power the pressure transducers. In each zone pressure sensor box, the output of a commercially available pressure transducer varies in response to zone pressure. This signal is sent back to the master panel, fed through an operational amp and drives an ammeter (master panel pressure gauge). Additionally, the signal from the operational amp is inputed to three comparators which in turn drive the appropriate lamps.

For a better understanding of the present invention, together with other objects, features and advantages of the invention not specifically mentioned, reference should be made to the accompanying drawings and following description, while the scope of the invention will be pointed in the appended claims.

DETAILED DESCRIPTION OF THE PREFERRED EMBODIMENT

Figure 1:
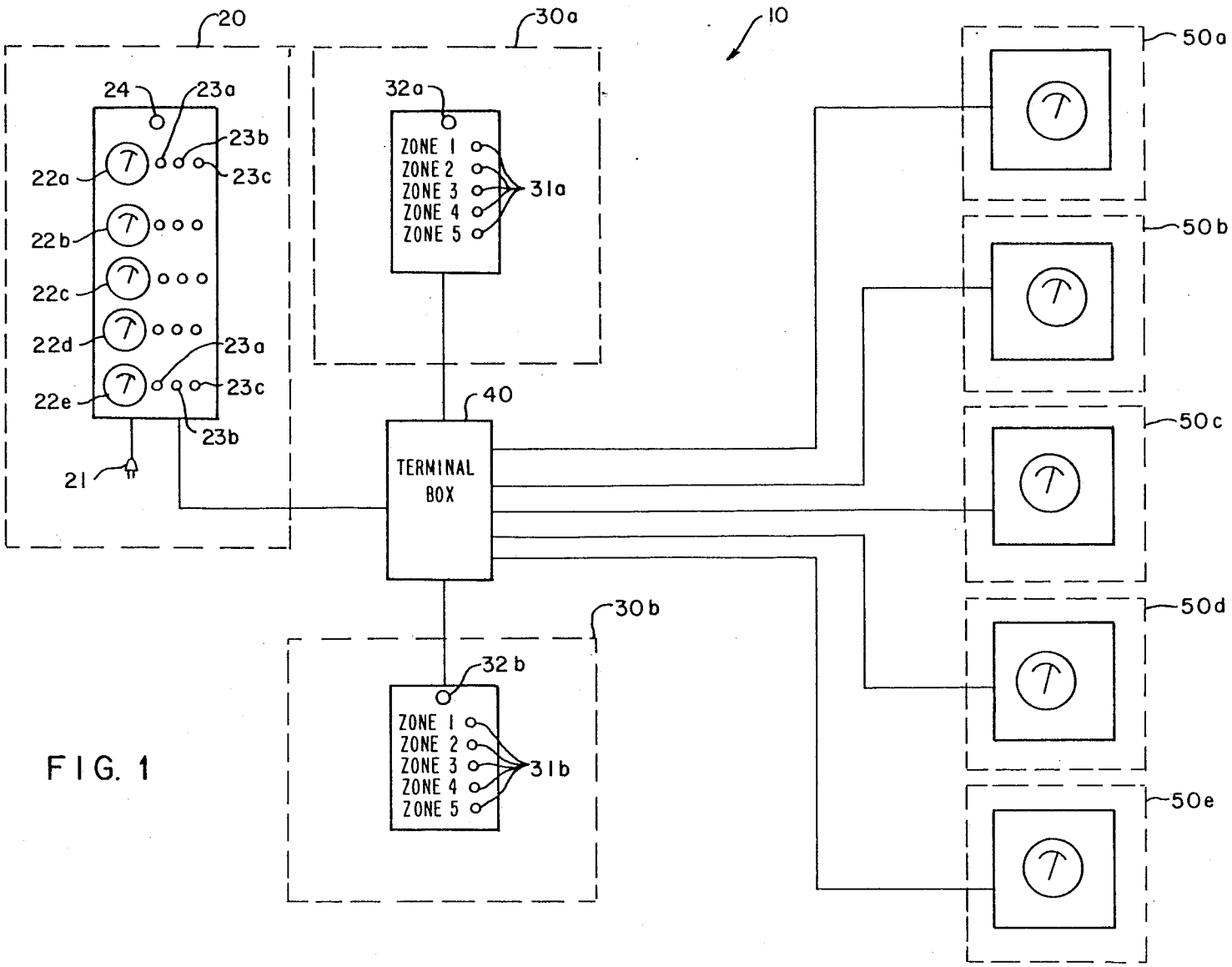
FIG. 1 is a block diagram of the circuit of the CPS alarm of the present invention.

Referring to the drawings, first to FIG. 1, the numeral 10 generally designates the Collective Protection System (CPS) alarm of the present invention. Numeral 20 is the master panel where a plurality of ammeters, *22a*, *22b*, *22c*, *22d* and *22e*, provide a visual meter deflection showing the overpressure in each respective zone. A series of three lights *23a*, *23b* and *23c*, provide a color-coded visual indication for each zone overpressure. When the system is properly calibrated, the red light *23a*, associated with each master panel meter, will light when the overpressure in the corresponding zone falls below 0.4 inches of water (gauge). The yellow light, *23b*, will be lit when pressure in the zone is between 0.4 and 1.5 inches of water (gauge). Likewise, the green light, *23c*, will illuminate when overpressure in the associated zone exceeds 1.5 inches of water.

The master panel chosen for illustration in FIG. 1 and corresponding to one embodiment actually reduced to practice and scheduled for incorporation into selected United States Navy warships monitored five zones and had a meter and 3 light series for each zone. The number of zones monitored is a design choice and it should be understood that the CPS alarm system of the present invention can be constructed to monitor one or any number of zones without departing from the scope of the invention. Master panel 20 is connected to ships power, 110 V/60 Hz. Standard circuitry (not shown) develops a 12 VDC component which is sent via terminal box 40 to each zone pressure sensor box to power the pressure transducers. This 12 VDC component also powers the electronic modules (not shown), one for each zone monitored, that are contained in master panel 20.

Figure 2:
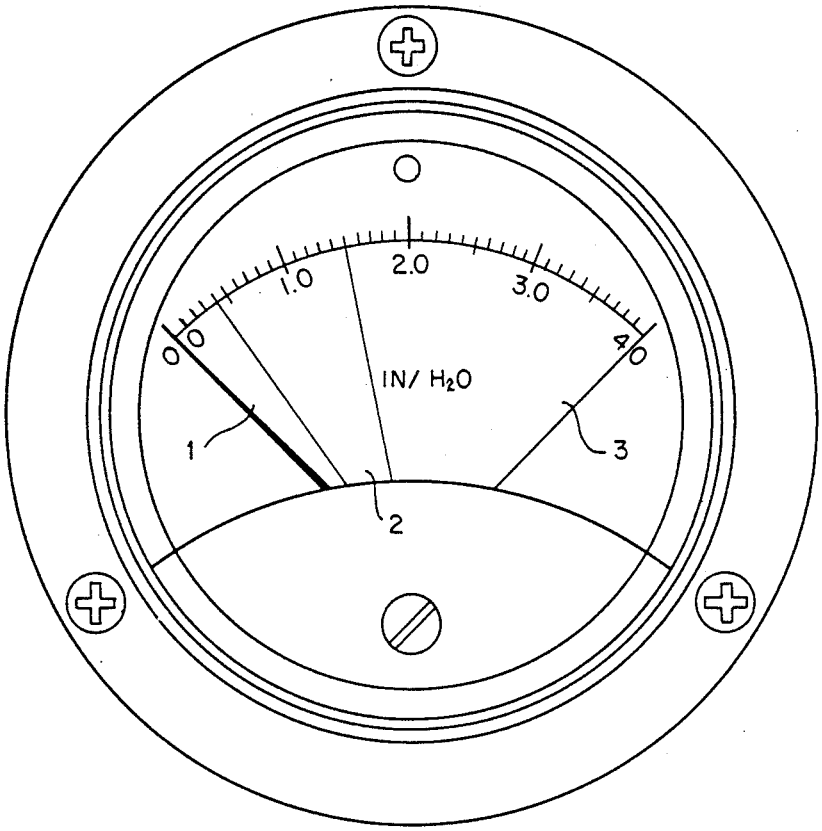
FIG. 2 is a graphic illustrating a triparte meter face utilized in the CPS system of FIG. 1.

FIG. 2 is a graphic showing a specially constructed meter face that is divided into three zones. Zone one corresponds to readings that indicate overpressure is lost in the associated zone and is colored red to correspond with the light on the master panel that will be lit when zone pressure is less than 0.4 inches of water (gauge). Zone two is color-coded yellow and zone three green so that the meter deflection reads in the zone colored to correspond with the light that is lit on the master panel.

Continuing with FIG. 1, two slave indicator panels *30a* and *30b* are wired through terminal box 40 to lights *23a* on master panel 20. The slave panels *30a* and *30b* each have a series of red lights, *31a* and *31b* respectively, that illuminate in correspondence with the red lights, *23a*, on the master panel, thus providing a visual alarm at the two remote slave panel positions when overpressure is lost in any of the zones monitored.

FIG. 1 also shows the zone sensor boxes, *50a* through *50e*, which are all connected through terminal box 40 to the master panel 20. These zone sensor boxes supply an electrical signal through electronic circuitry in master panel 20 to their respective ammeters, *22a* through *22e*, on the master panel, which in turn indicate the overpressure in the zones.

Ammeters of a type available commercially from multiple sources that will function acceptably in the CPS alarm system of the present invention are available from Triplett. The Triplett 0–200 DC Micrometer, Mil Spec Ruggedized, Type MR36W200 DCUAR (Triplett #321-HR-152-2030) is available from Metermetrics, 7400 Whitepine Road, Richmond, Virginia 23237. The meter face detailed in FIG. 2 can be ordered along with the ammeters from Metermetrics by specifying the meter face depicted in FIG. 2.

It should be noted that terminal box 40 and all interconnected wiring in the system is constructed from shielded cable to eliminate RFI and EMI interference.

It should be noted that the embodiment actually built and illustrated herein contained two remote slave panels with one red light slaved to each red light contained on the master panel. It is within the scope of this invention to have any number of slave panels and to have them slaved to and indicating the status of the full series of lights, red, yellow and green, or just yellow and red. The red lights may also be in electrical connection with an audio alarm so that illuminating any red light on the master panel might provide an audio alarm at the site of the master panel, the site of one or more slave panels or at any remote site selected.

Figure 3:
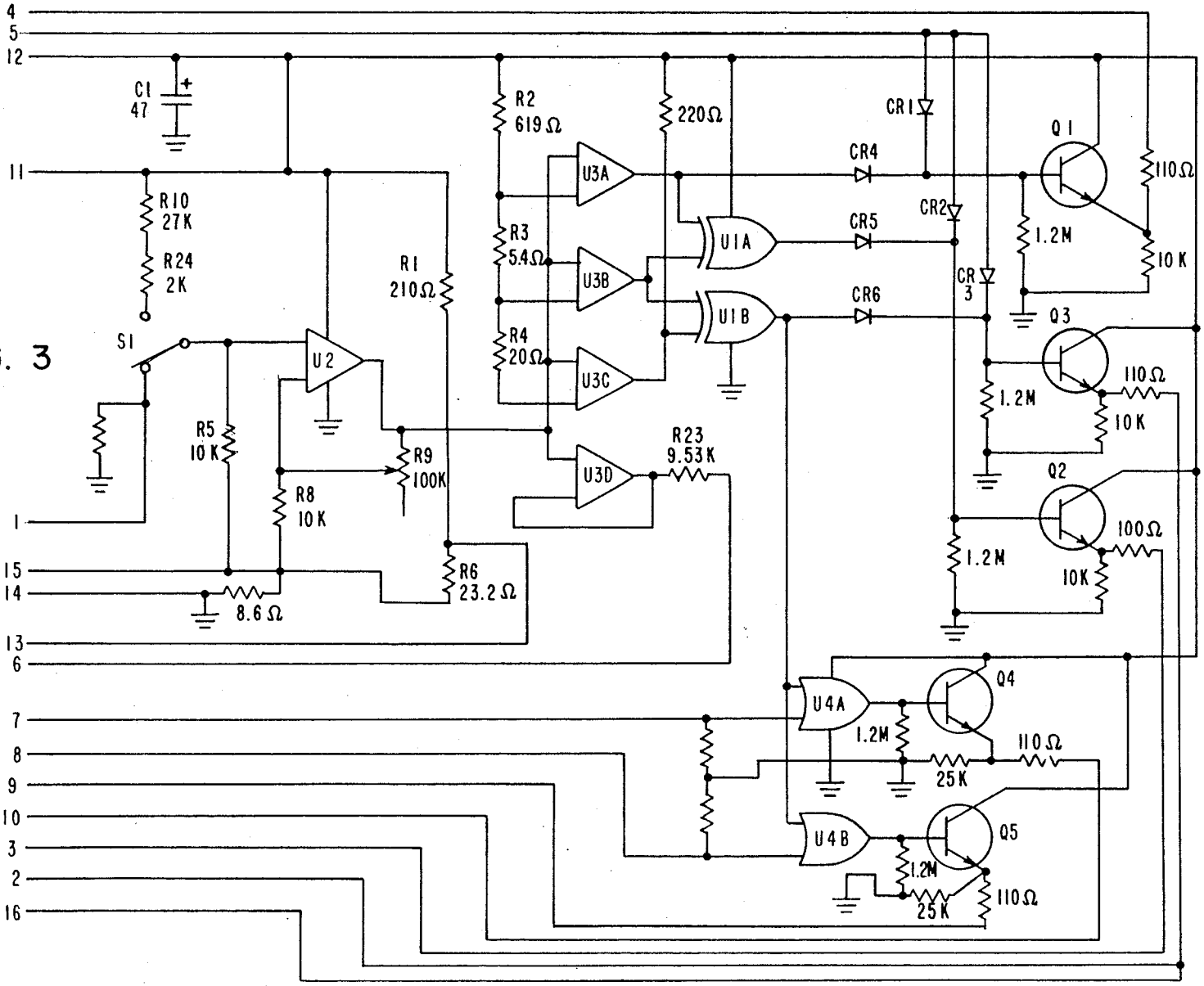
FIG. 3 is a schematic of the CPS alarm electronics of FIG. 1.

Turning now to FIG. 3, a schematic of the electronic circuitry for each zone is shown. A circuit comparable to the one illustrated in FIG. 3 is constructed with standard artwork on a plug-in module, properly keyed to preclude upside-down installation, one for each zone monitored. These electronic modules (not shown) are contained in master panel 20.

Turning now to FIG. 3, a schematic illustrating the electric circuits used to process the outputs of the zone pressure monitor boxes is provided for additional understanding. A circuit such as the one illustrated is provided for each individual zone monitored and in the embodiment chosen for illustration in FIG. 1, 5 circuits of this type are contained in master panel 20 mounted one per module and corresponding to meters 22*a* through 22*b*.

Beginning on the left side of FIG. 3, an input signal from the transducer in the respective zone enters pin 1 through S1 to an operational amplifier U2. The amplified signal from the zone transducer, now the output from U2, is sent to four comparitors, U3A, U3B, U3C and U3D. Three comparitors, U3A, U3B and U3C, are biased through a voltage divider comprised of R2, 619 ohms, R3, 54.9 ohms and R4, 20 ohms. When the input from the transducer is at an amplitude indicating pressure in the zone is below 0.4 inches of water (gauge) pressure, only U3C and not U3B is fed to one input of an exclusive OR gate, U1B. With U3B not conducting the second input to exclusive OR gate U1B is low and the gate conducts, sending a signal through CR6 to the base of Q3. An output from the emitter of now conducting Q3 exits this schematic at pin 2 where it is sent to master panel 20 to light the red light corresponding to the zone under analysis.

When zone pressure increases to between 0.4 and 1.5 inches of water (gauge), the input signal in pin one through S1 and U2 is of enough amplitude to turn on both U3C and U3B. Exclusive OR gate U1B switches off as both inputs to the gate are high resulting in Q3 turning off and extinguishing the red light. The output of U3B is fed to the exclusive OR gate U1A which switches on, providing an output through CR5 to the base of Q2. The output from the emitter of Q2 exits pin 3 of the schematic where it illuminates a yellow light at master panel 20.

When overpressure in the zone is above 1.5 inches of water and a condition green is extant, the input signal to U3A, U3B and U3C is adequate to cause the three comparitors to conduct, resulting in both inputs to U1A and U1B being high and shutting off both exclusive OR gates. This keeps both Q2 and Q3 in a nonconductive state and results in both the yellow and red status lights on master panel 20 being extinguished. The output of U3A, however, is fed through CR4 directly to the base of Q1 turning Q1 on. The output of Q1 exits this schematic at pin 4 to light the green light at the master control panel.

The valves of R2, 619 ohms, R3, 54.9 ohms and R4, 20 ohms, were carefully chosen to bias U3A, U3B and U3C so that they conduct when the magnitude of zone pressure indicates they should illuminate their respective light.

A conventional lamp test feature is included by bringing in 12 VDC on pin 5 through CR1, CR2 and CR3 to the base of Q1, Q2 and Q3 thus lighting all three lamps. A standard press-to-test button 24 on master panel 20 applies this 12 VDC signal to pin 5 of all zone monitor circuits, thus testing all pressure-indicator lights on the panel.

The output of the operational amp U2 is also fed to U3D which acts as a line driver for the signal to exit pin 13 and drive the associated ammeter on the master panel.

The two remote slave panels also have a lamp test circuit 32*a* and 32*b* to test their respective red lights. A 12 VDC test signal enters pin 7 when lamp test button 32*a* is pushed on remote slave panel 30*a* or pin B when the lamp test button 32*b* is pushed on slave panel 30*b*. These signals qualify OR gates U4A and U4B, switching on their respective transistors Q4 and Q5, then out pin 9 or 10 to light a corresponding red light on the slave panels. During operation, a signal to Q4 and Q5 is fed from the output of XOR U1B to appropriately light the red lights on the slave panels when overpressure in the monitor zones is below 0.4 inches of water.

Pin 12 provides 12 VDC power to the components as well as out pin 11 to the pressure transducer in the associated monitor zone. Pin 14 is circuit ground and R7, 80.6 ohms is a resistor chosen to keep the pressure transducers floating above ground and operating on the optimum part of their characteristic curves. Pin 15 connects this floating ground to the ground wire on the transducer.

A 12 VDC buzzer or Klaxon® (not shown) may be connected to the emitter circuit of Q3 at pin 16. This audio alarm can be installed at master panel, slave panel, protection zone or fed into an intercom to provide audio warning of loss of overpressure as design requires.

The system should be calibrated to marry the lights and meters. Calibration is accomplished by switching S1 to the calibrate position which connects a DC voltage from the 12 VDC line through R10 and R11 to operational amp U2. R9 100 kilohms potentiometer is then adjusted so that the master panel meter associated with the electronic circuit reads 2 in/$H_2O$. The green light associated with the meter will also be lit. Note that R10, 27 kilohms and R24, 2 kilohms were chosen to provide the correct amplitude adjustment signal. Finally, pin 15 provides a return line from the master panel meter to the electronic circuit.

A fine adjust calibration is also requisite to calibrate the master panel meter to the mechanical pressure meter located in the respective zone pressure monitor unit 50*a*–50*e*. Refining the adjustment of R9 will ensure the two meters are married. Pressure in the zone monitor should be above 1 in/$H_2O$ when making the fine adjustment.

Figure 4:
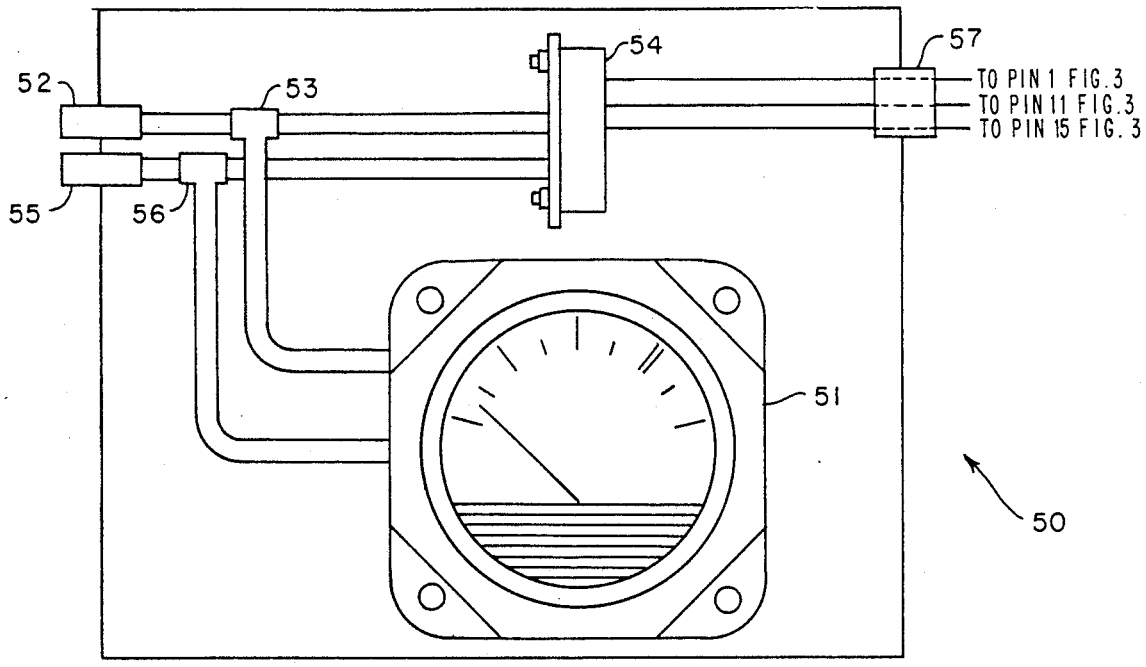
FIG. 4 is a diagram illustrating the zone monitor units of FIG. 1.

Turning now to FIG. 4, numeral 50 designates one of the zone sensor units. Therein a mechanical magnehelic differential pressure gauge 51 is connected to zone pressure through tee 53 from zone monitored pressure inlet 52. Zone pressure is also fed to the pressure transducer 54. Inlet 55 provides ambient outside air pressure through tee 56 to both the pressure transducer 54 and the mechanical differential meter 51. The transducer outputs a signal corresponding to the pressure differential through a three-pin connector 57 to pin 1 of the electronic circuit of FIG. 2. Likewise, pin connector 57 provides power and a floating ground to transducer 54 from pins 11 and 15 respectfully, as shown in FIG. 2.

The mechanical meter used in the preferred embodiment chosen for illustration and actually built and tested is a magnehelic differential pressure gauge, model #12-164786-00 available commercially from DWYER® Instruments, Inc., P.O. Box 373, Michigan City, Indiana 46360.

The pressure transducer is a low pressure sensor model #164PC01D37 available commercially from MICRO SWITCH®, 11 W. Spring St., Freeport, IL 61032.

FIG. 3, illustrating the electronic circuit actually employed in the working model, contains actual values used to construct the best mode to practice the invention. It should be understood, however, that the invention can be practiced with electronic circuits constructed from other components having other values without departing from the scope of the invention.

The components chosen for the embodiment illustrated in the schematic of FIG. 3 are all available commercially from multiple sources. For example, the operational amplifier U2 is LM741, U3A, U3B, U3C and U3D are all contained in QUAD amplifier LM 148, and XOR gates U1A and U1B used CD 4030 components and a CD 4070 was used for OR gates U4A and U4B. All transistors Q1, Q2, Q3, Q4, and Q5, are 2N2222A general switching transistors. All these components are available from National Semiconductor ®, 2900 Semiconductor Dr., Mail Stop 23-200, Santa Clara, CA 95051. Fairchild Camera and Instrument Corp., 464 Ellis St. Mountain View, CA 94042 is an alternate source for all above components. The diodes used were Si Diodes, 50 PIV number IN4001 or IN414B, also available commercially from Fairchild Camera and Instrument Corp. supra.

the present invention uses a solid state circuit easily incorporated through standard art work to a plug in a module. Each module is identical for each monitor zone and the modules are interchangeable for quick troubleshooting. Additional modules can be added to monitor additional zones. Likewise, additional slave panels can be added to provide fail indications at multiple remote sites.

Thus, it can be seen that the present invention accomplishes at least all of its stated objectives.

Obviously many modifications and variations of the present invention are possible in light of the above teachings. It is, therefore, to be understood that, within the scope of the appended claims, the invention may be practiced otherwise than as specifically described.

What is claimed is:

1. A collective protection system alarm comprising:
one or more zone monitoring stations containing at least one pressure transducer remote from but in electrical connection with;
a master display panel having a plurality of ammeters in signal correspondence with said one or more zone monitoring stations; and
one or more slave display panels physically remote from both said one or more zone monitoring stations and said master display panel whereby status of ambient pressure surrounding said one or more zone monitoring stations may be monitored at one or more sites remote from said master display panel and said zone monitoring stations.

2. A collective protection system according to claim 1 wherein said master display panel is further defined by a series of pressure status lights for each remote area monitored.

3. A collective protection system according to claim 1 wherein a series of pressure status lights corresponds to each of the ammeters in said master display panel.

4. A collective protection system according to claim 1 wherein all electronic wiring is shielded to preclude EMI or RFI interference.

5. A collective protection system according to claim 1 wherein said one or more zone monitoring stations are further defined by a mechanical pressure meter in pressure correspondence with at least one pressure transducer.

6. A collective protection system according to claim 1 wherein said master display panel comprises 5 ammeters corresponding with 5 remote pressure transducers.

7. A collective protection system according to claim 6 further defined by a set of three status lights corresponding to three pressure gradients indicated by each of said ammeters.

8. A collective protection system alarm comprising:
a master display panel comprising a plurality of analog pressure indicator meters corresponding with,
a plurality of remote differential pressure transducers in separate pressure monitoring areas; and
a series of three status indicating lights corresponding with each of said analog meters, and
on or more slave display panels in electrical correspondence with one or more status indicating lights in each of said light series.

9. A collective protection system according to claim 8 wherein all electronic wiring is shielded to preclude EMI or RFI interference.

10. A collective protection system according to claim 8 wherein said series of three status lights comprises:
a red light to illuminate whenever said corresponding differential pressure transducer indicates an overpressure differential of less than 0.4 inches of water (gauge); and
a yellow light to illuminate whenever said corresponding differential pressure transducer indicates an overpressure differential of 0.4 to 1.5 inches of water (gauge); and
a green light to illuminate whenever said corresponding differential pressure transducer indicates overpressure in its monitoring area is greater than 1.5 inches of water (gauge).

11. A collective protection system according to claim 10 wherein said one or more slave display panels comprises one red light to illuminate in correspondence with each of said red lights on said display panel.

12. A collective protection system according to claim 8 further defined by an audio alarm initiated whenever the signal from any one of said analog pressure indicator meters indicates overpressure in said monitoring level is below a predetermined level.

13. A collective protection system according to claim 12 wherein said audio alarm is integral with said master display panel.

14. A collective protection system according to claim 13 further defined by an audio alarm integral with said master display panel; and
an audio alarm integral with each of said one or more slave display panels in correspondence with said red lights whereby illumination of any of said red lights will activate said audio alarm.

15. A collective protection system comprising;
one or more zone monitoring units each comprising a mechanical pressure differential meter in pressure correspondence with a pressure differential transducer;
a master display panel with an ammeter in signal correspondence with each of the pressure differential transducer in each of the zone monitoring units and a series of three red, yellow and green lights corresponding with the signal from the pressure differential transducers whereby said red light illuminates when the signal from its corresponding transducer indicates differential pressure below a predetermined level in the associated monitoring zone, and said green light illuminates whenever the signal indicates overpressure is above a predetermined level, and said yellow light is illuminated when the signal indicates an overpressure between the predetermined levels which illuminate said red and green lights; and one or more slave indicator panels remote from both said one or more zone monitoring stations and said master display panel comprised of one red light in electrical connection and illuminated in conjunction with each of said red lights on said master panel.

16. A collective protection system according to claim 15 comprising 5 zone monitoring units.

17. A collective protection system according to claim 15 further defined by a shielded terminal box; and shielded electronic wiring interconnecting each of said components whereby EMI and RFI interference is avoided in said collective protection system.

18. A collective protection system according to claim 17 wherein said monitoring units are 5 in number.

19. A collective protection system according to claim 15 wherein said master panel is further defined by electronic circuitry therein to adjustably set the pressure levels at which said lights illuminate.

20. A collective protection system according to claim 19 wherein said electronic circuitry is solid state electronics mounted on plug-in modules, one for each of said zone monitoring units.

* * * * *